United States Patent [19]

Igashira et al.

[11] Patent Number: 4,579,283

[45] Date of Patent: Apr. 1, 1986

[54] PRESSURE RESPONSIVE FUEL INJECTOR ACTUATED BY PUMP

[75] Inventors: Toshihiko Igashira, Toyokawa; Yasuyuki Sakakibara, Nishio; Toru Yoshinaga; Seiko Abe, both of Okazaki; Kazuhide Watanabe, Toyohashi, all of Japan

[73] Assignee: Nippon Soken, Inc., Nishio, Japan

[21] Appl. No.: 619,193

[22] Filed: Jun. 11, 1984

[30] Foreign Application Priority Data

Jun. 16, 1983 [JP] Japan ..... 58-106698

[51] Int. Cl.[4] ..... F02M 47/02

[52] U.S. Cl. ..... 239/88; 239/102

[58] Field of Search ..... 239/88–92, 239/533.2–533.12, 585, 101, 102; 123/446, 498; 417/560, 322

[56] References Cited

U.S. PATENT DOCUMENTS

| | | | |
|---|---|---|---|
| 1,843,410 | 8/1929 | Von Salis | 239/89 |
| 2,173,811 | 9/1939 | Bischof | 123/446 |
| 2,397,136 | 5/1944 | French | 239/90 X |
| 2,985,378 | 5/1961 | Falberg | 239/91 X |
| 3,115,304 | 12/1963 | Humphries | 239/90 |
| 3,194,162 | 7/1965 | Williams | 239/102 X |
| 3,418,980 | 12/1968 | Benson | 417/322 X |
| 3,976,249 | 8/1976 | Jarret | 239/91 X |
| 4,082,481 | 4/1978 | Fenne | 123/498 X |
| 4,463,725 | 8/1984 | Lauter et al. | 239/88 X |
| 4,471,740 | 9/1984 | Jourde et al. | 239/90 X |

FOREIGN PATENT DOCUMENTS

| | | | |
|---|---|---|---|
| 2251125 | 4/1973 | Fed. Rep. of Germany | 239/92 |
| 3030378 | 2/1982 | Fed. Rep. of Germany | 239/101 |
| 59-206668 | 11/1984 | Japan . | |
| 907287 | 2/1982 | U.S.S.R. | 239/533.5 |

*Primary Examiner*—Andres Kashnikow
*Assistant Examiner*—Kevin P. Weldon
*Attorney, Agent, or Firm*—Cushman, Darby & Cushman

[57] ABSTRACT

A fuel injector for an internal combustion engine, the injector being actuated by a piezoelectric actuator. The piezoelectric actuator operates a piston, which changes the volume of a pump chamber formed between the piston and a nozzle needle. The nozzle needle moves up and down in response to a pressure in the pump chamber to open and close a port for injecting fuel. The piston is pressed toward the pump chamber by a fluidic force or a spring force and so on.

9 Claims, 2 Drawing Figures

PRESSURE RESPONSIVE FUEL INJECTOR ACTUATED BY PUMP

BACKGROUND OF THE INVENTION

1. Field of the Invention

The present invention relates to a fuel injector for an internal combustion engine, more particularly to a fuel injector whose valve is opened and closed by a piezoelectric actuator.

2. Description of the Related Art

The faster a fuel injector can open and close its injecting port, that is, the faster a fuel injector can be actuated, the more accurately the fuel injector can be controlled and the more efficiently an engine having the fuel injector can be operated. Conventional solenoid actuators for opening and closing an injecting port take more than 1 msec for response. Piezoelectric actuators offer faster response, but have the drawback of insufficient valve lift.

The present inventors previously proposed a fuel injector offering both the fast response of a piezoelectric actuator and a sufficient valve lift in Japanese Patent Application No. 58-3637, which was laid open Nov. 22, 1984 under No. 59-206668 and hence is not "prior art" hereto. In this fuel injector, however, an excessively large load is applied on the actuator when the fuel supply pressure is very large. Therefore, this fuel injector cannot be made sufficiently compact.

SUMMARY OF THE INVENTION

Accordingly, the present invention has as its object to provide a fuel injector which has not only quick response and sufficient valve lift, but also small size through reduction of the load applied thereto.

According to the present invention, there is provided a fuel injector which comprises a body, a piezoelectric actuator, a piston, a nozzle needle, pressing means, and supplying means. The body has a first cylinder bore, a second cylinder bore, and an injecting port for injecting fuel. The piezoelectric actuator is confined in the body and expands and contracts in response to an electric potential difference applied thereto. The piston is slidably disposed in the first cylinder bore, one side of the piston engaging with the actuator and the other side of the piston defining a pump chamber in the first cylinder bore. The piston moves according to the expansion and contraction of the actuator to change the volume of the pump chamber. The nozzle needle is movably disposed in the second cylinder bore and has a first surface subject to pressure in the pump chamber and a second surface subject to pressure directed in the opposite direction of the pressure in the pump chamber. The nozzle needle can open and close the injecting port by being subjected to both pressures. The pressing means presses the piston toward the pump chamber with a lower force than the pressure in the pump chamber. The supplying means supplies pressurized fuel to the injecting port, the second surface of the nozzle needle, and the pump chamber.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Figure 1:
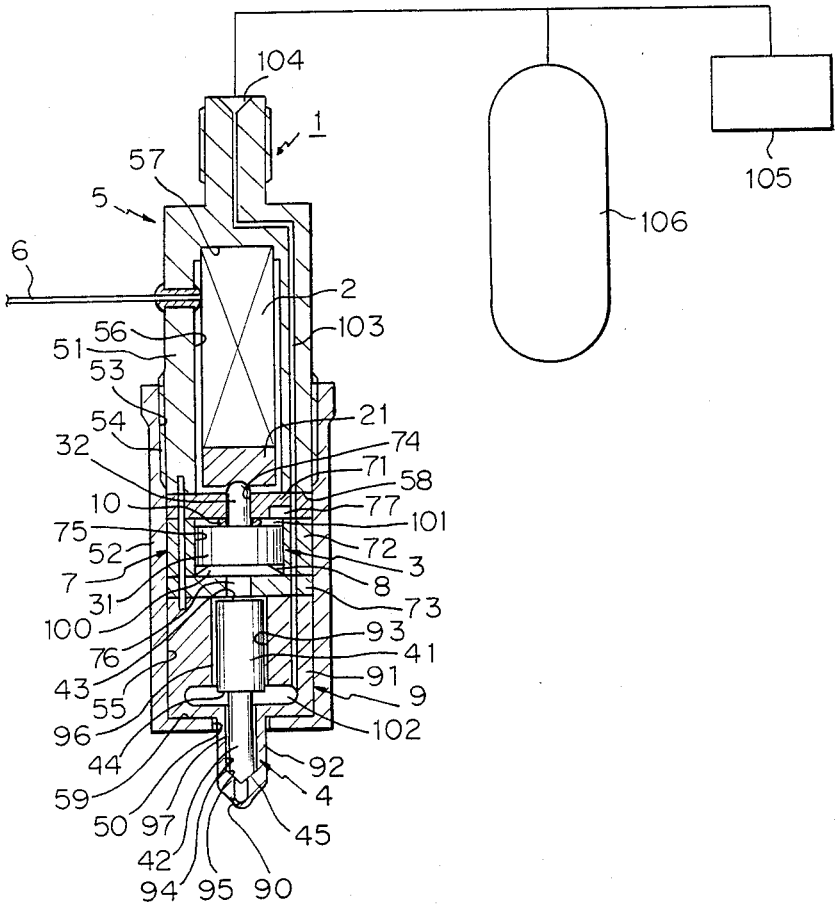
FIG. 1 is a sectional view of a first embodiment of the present invention.

FIG. 1 is a sectional view along the central axis of a first embodiment of the present invention. Referring to FIG. 1, a fuel injector is generally indicated by reference numeral 1. This fuel injector 1 has a piezoelectric actuator 2, which actuates a piston 3 so that a nozzle needle 4 opens and closes an injecting port 90 for injecting fuel.

A casing 5 of the fuel injector 1 is composed of a tubular nozzle holder 51 and a tubular retaining nut 52. The retaining nut 52 has a larger inner diameter than the outer diameter of the nozzle holder 51. The retaining nut 52 is connected to the nozzle holder 51 by threadingly fitting a female screw 53 of the retaining nut 52 to a male screw 54 of the nozzle holder 51, so that a cylindrical space having a large diameter portion 55 and a small diameter portion 56 is formed in the nozzle holder 51 and the retaining nut 52.

The piezoelectric actuator 2 is disposed in the small diameter portion 56. One end of the actuator 2 abuts an inner end wall 57 of the nozzle holder 51, and another end of the actuator 2 is fixedly provided with a pressure plate 21. The piezoelectric actuator 2 expands and contracts in response to an electric potential difference applied thereto through a lead line 6.

The piezoelectric actuator 2 is a cylinder formed of about 50 laminated piezoelectric disks. The piezoelectric disks are made of a ceramic called PZT whose main component is $PbTiO_3$-$PbZrO_3$. The piezoelectric disks expand 1 $\mu$m in the thickness direction when 500 volts is applied thereto. Therefore, the piezoelectric actuator 2 expands by 50 $\mu$m in the axial direction upon application of 500 volts and contracts by 50 $\mu$m to return to the initial length when the voltage is removed or a negative voltage is applied.

A cylinder 7 is disposed in the retaining nut 52. The cylinder 7 comprises a disk 71, a cylinder member 72, and a distance piece 73. The disk 71 is provided so that one side thereof contacts an end surface 58 of the nozzle holder 51 and is formed with a hole 74. The cylinder member 72 is provided adjacent to the disk 71 and has a first cylinder bore 75. The distance piece 73 is provided adjacent to the cylinder member 72 and is formed with an opening 76.

The piston 3 is disposed in the cylinder 7. The piston 3 has a large diameter portion 31 and a small diameter portion 32. The large diameter portion 31 is slidably sealingly supported by the first cylinder bore 75, and the small diameter portion 32 is slidably supported by the hole 74 of the disk 71. An end portion of the small diameter portion 32 projects from the disk 71 and contacts the pressure plate 21. The bottom surface of the piston 3 faces the upper surface of the distance piece 73 and defines a pump chamber 100 in the first cylinder bore 75. A conical spring 8 is disposed in the pump chamber 100 so that the upper end portion of the piston 3 always contacts the pressure plate 21.

Therefore, when an electric potential difference is applied to the piezoelectric actuator 2 through the lead line 6, the actuator 2 expands and contracts, whereby the pressure plate 21 moves down and up. As a result, the piston 3 descends and ascends to change the volume of the pump chamber 100.

The upper surface of the large diameter portion 31 defines a pressure chamber 101 in the first cylinder bore 75. In this pressure chamber 101, a seal ring 10 is provided at a peripheral portion of the hole 74 so that the chamber 101 is shut from a space of the nozzle holder 51. As described hereinafter, pressurized fuel is supplied to the pressure chamber 101 so that the piston 3 is pressed down.

A nozzle body 9 is disposed in the retaining nut 52. The nozzle body 9 has a thick cylinder portion 91 and a slender cylinder portion 92. The thick cylinder portion 91 is fitted in the retaining nut 52, the upper end surface thereof being in contact with the distance piece 73, the lower end surface thereof being in contact with the bottom end surface 59 of the retaining nut 52. The slender cylinder portion 92 projects to the outside of the retaining nut 52 through a hole 50 which is formed in the bottom plate of the nut 52. The injecting port 90 is formed in an end portion of the slender cylinder portion 92.

A second cylinder bore 93 is formed in the thick cylinder portion 91. The nozzle needle 4 is disposed in the second cylinder bore 93 so that the needle 4 moves along the axis thereof. The nozzle needle 4 has a large diameter portion 41 and a small diameter portion 42. The large diameter portion 41 is loosely fitted in the second cylinder bore 93, and the small diameter portion 42 is loosely fitted in a needle bore 94 formed in the slender cylinder portion 92 of the nozzle body 9. A clearance 96 between the large diameter portion 41 and the second cylinder bore 93 is radially about 20 μm, and a clearance 97 between the small diameter portion 42 and the needle bore 94 is about 1 μm.

The nozzle needle 4 has a first surface 43 at the upper end thereof and has a second surface 44 between the large diameter portion 41 and the small diameter portion 42. The first surface 43 is a smooth plane formed by polishing and can tightly contact the under surface of the distance piece 73, which is also a smooth plane formed by polishing, so that the first surface 43 fluid-tightly closes the opening 76. The second surface 44 faces a fuel reservoir 102 as set forth below.

The fuel reservoir 102 is formed between the second cylinder bore 93 and the needle bore 94 and communicates with both bores 93 and 94. The fuel reservoir 102 is larger than the second cylinder bore 93 in diameter so that the reservoir 102 can hold some quantity of fuel. As described hereinafter, pressurized fuel is supplied to the fuel reservoir 102, so that the pressure of fuel acts on the second surface 44.

Thus, the nozzle needle 4 is given an upward force from a pressure in the fuel reservoir 102 and is given a downward force from a pressure in the pump chamber 100 which communicates with the second cylinder bore 93 through the opening 76. That is, the nozzle needle 4 moves along the axis thereof according to the pressures in the pump chamber 100 and the fuel reservoir 102.

The nozzle needle 4 has a valve surface 45 on the lower end surface of the small diameter portion 42. The valve surface 45 can tightly contact a valve seat 95 which is formed in a lower portion of the needle bore 94 so that the nozzle needle 4 shuts the injecting port 90. Thus, the nozzle needle 4 can move up and down between the first position in which the first surface 43 contacts the distance piece 73 and the second position in which the valve surface 45 contacts the valve seat 95. The limit of movement of the nozzle needle 4 is about 50 μm.

The fuel reservoir 102 is supplied with pressurized fuel through a fuel passage 103, which is formed in the nozzle body 9, the distance piece 73, the cylinder member 72, the disk 71, and the nozzle holder 51. The fuel passage 103 communicates with an entrance port 104 formed at the upper end portion of the nozzle holder 51. The entrance port 104 is connected to a fuel source 105 through an accumulator 106, which comprise a pump and a pressure regulator, respectively. The accumulator 106 always accumulates fuel pressurized to 800 atmospheres and keeps the pressure thereat.

Fuel supplied to the fuel injector 1 through the accumulator 106 is transferred to the fuel reservoir 102 through the fuel passage 103. The fuel in the reservoir 102 enters the needle bore 94. If the nozzle needle 4 moves upward so that the injecting port 90 opens, the fuel is jetted through the port 90. On the other hand, when the valve surface 45 sealingly contacts the valve seat 95, the port 90 is shut, so that the fuel is not jetted out.

Fuel is supplied to the pump chamber 100 through the second cylinder bore 93 and the hole 76. Fuel is also supplied to the pressure chamber 101 through a notch 77 formed on the disk 71. The notch 77 communicates the pressure chamber 101 to the fuel passage 103 of the disk 71. Therefore, the pressure chamber 101 is also supplied with pressurized fuel, so that the piston 3 is pressed downward, that is, toward the pump chamber 100. The pressure in the pressure chamber 101 is nearly equal to the force which presses the piston 3 upward, but the pressure is somewhat smaller than the force.

It should be noted that a knock pin 11 is provided so that the nozzle body 91, the distance piece 73, the cylinder member 72, the disk 71, and the nozzle holder 51 are rigidly fixed to each other, whereby the fuel passage 103 is formed to communicate from the entrance port 104 to the fuel reservoir 102.

The first embodiment constructed as stated above operates as follows. At the time when a fuel injection operation is to be stopped, 500 volts is applied to the piezoelectric actuator 2. The actuator 2 thus expands by about 50 μm to press the piston 3 downward. At this time, the 800 atmosphere pressure accumulated in the accumulator 2 acts over the entire surface of the piston 12. The lower end surface of the large diameter portion 31 is pressed upward by the 800 atmosphere pressure, while the upper end surface of the large diameter portion 31 is pressed downward by the 800 atmosphere pressure. Therefore, the piston 3 is pressed upward by a force which corresponds to the pressure applied on an area whose sectional area is equal to the section of the small diameter portion 32. The piezoelectric actuator 2 expands with a larger force than the force applied on the piston 3 upward, so that the piston 3 moves downward against the conical spring 8. Fuel in the pump chamber 100 is pressurized to flow in the second cylinder bore 83 through the opening 76 so that pressure of the fuel acts on the first surface 43 of the nozzle needle 4. As a result, the nozzle needle 4 moves downward so that the valve surface 45 is pressed on the valve seat 95 and the fuel supply to the injecting port 90 is shut.

The pressurized fuel applied on the first surface 43 flows into the fuel reservoir 102 through the clearance 96. However, the pressure in the pump chamber 100 does not fall below the pressure of the fuel reservoir 102, that is, the pressure of the accumulator 106. Therefore, a pressure of at least 800 atmospheres keeps acting on the first surface 43 of the nozzle needle 4. The second surface 44 is pressed upward by the fuel pressure of 800 atmospheres in the fuel reservoir 102, however, the force pressing the surface 44 is smaller than the force applied downward on the nozzle needle 4. Therefore, the nozzle needle 4 is kept to be pressed downward so that the valve surface 45 keeps sealing contact on the valve seat 95. That is, the fuel injector 1 keeps the injecting port 90 closed.

When a fuel injection operation is to be started, a slight negative voltage is applied on the piezoelectric actuator 2 to remove the above 500 volt voltage. The piezoelectric actuator 2 contracts by about 50 μm, so that the piston 3 is moved upward until the force acting upward equals the force acting downward. As a result, the pressure in the pump chamber 100 is reduced by a magnitude which corresponds to the ratio of the sectional area of the pump chamber 100 to the sectional area of the pressure chamber 101. Therefore, the nozzle needle 4 is moved upward by the 800 atmosphere pressure in the fuel reservoir 102 so that the first surface 43 sealingly contacts the lower surface of the distance piece 73. In this condition, the downward force acting on the nozzle needle 4 is smaller than the upward force acting on the nozzle needle 4. Therefore, the injecting port 90 communicates with the fuel reservoir 102 to keep injecting fuel. That is, the fuel injector 1 keeps the injecting port 90 open.

Then, an operation for stopping the injection takes place, as described above. Thus, this fuel injector 1 can inject fuel at any time and at any period in response to engine requirements.

Figure 2:
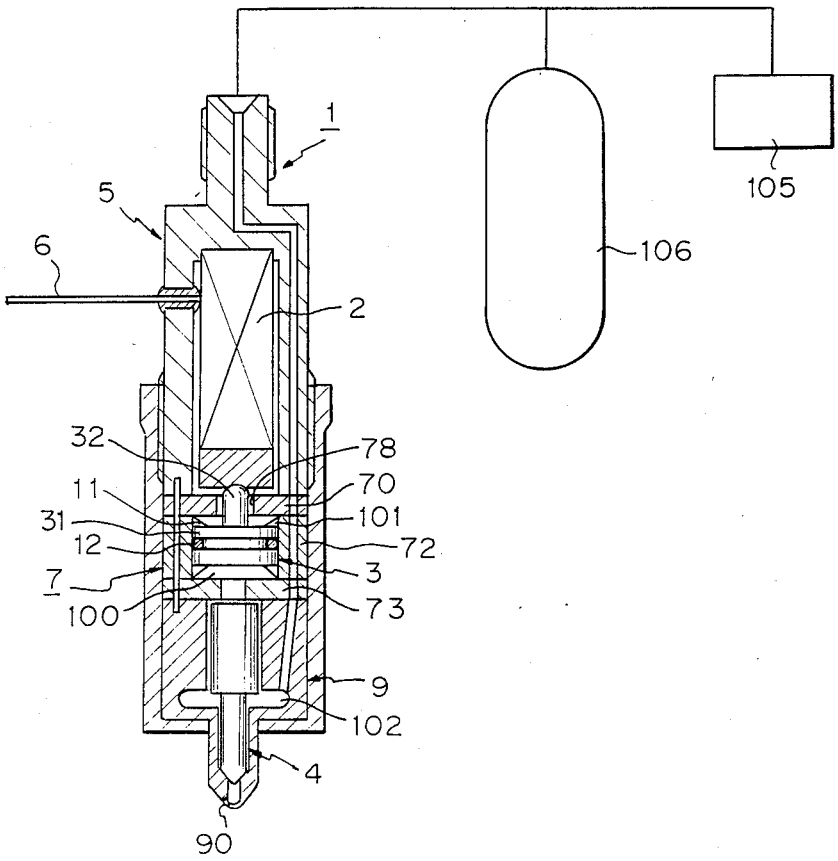
FIG. 2 is a sectional view of a second embodiment of the present invention.

FIG. 2 shows a second embodiment of this invention. In the first embodiment, a fuel pressure was led to the pressure chamber 101. In the second embodiment, however, the pressure chamber 101 is provided with a conical spring 11, and a seal ring 12 is fitted on an outer peripheral surface of the large diameter portion 31 of the piston 3. Further, in the second embodiment, the disk 71 is replaced with a spacer 70 which has the same diameter as the disk 71 and the distance piece 73. The spacer 70 has a hole 78 in which the small diameter portion 32 fits loosely and does not have the notch 77 as provided in the first embodiment. The spacer 70 constitutes a cylinder 7 with the cylinder member 72 and the distance piece 73. Other constructions of this embodiment are the same as those of the first embodiment.

Therefore, when stopping fuel injection, the piston 3 is pressed upward by a pressure of 800 atmospheres in the pump chamber 100, the pressure balancing with reaction forces of the conical spring 11 and the piezoelectric actuator 2. When starting fuel injection, the piezoelectric actuator 2 contracts so that the force acting between the piston 3 and the actuator 2 is reduced, and the piston 3 moves upward. Thus, the volume of the pump chamber 100 is increased so that the pressure in the chamber 100 is reduced to balance the reaction force of the conical spring 11, whereby the nozzle needle 4 is pushed up by the fuel pressure in the fuel reservoir 102. As a result, the injecting port is opened to inject fuel. Otherwise, the operation is the same as that of the first embodiment.

While the present invention has been described herein with reference to preferred embodiments, many modifications and changes may be made by those skilled in this art without departing from the scope of the invention.

We claim:

1. A fuel injector comprising:

a body having a first cylinder bore, a second cylinder bore, and an injecting port for injecting fuel;

a piezoelectric actuator confined in said body, said actuator expanding and contracting in response to an electric potential difference applied thereto;

a piston slidably disposed in said first cylinder bore, one side of said piston engaging with said actuator, another side of said piston defining a pump chamber in said first cylinder bore, said piston moving according to the expansion and contraction of said actuator to change the volume of said pump chamber;

a nozzle needle movably disposed in said second cylinder bore, said nozzle needle having a first surface subject to pressure in said pump chamber to urge said needle to close said port and having a second surface subject to another pressure to urge said needle to open said port, said nozzle needle being able to open and close said port by being subject to both said pressures;

means for pressing said piston toward said pump chamber with a force lower than that developed by the pressure in said pump chamber, the reaction force of said pressing means being isolated from said actuator; and means for supplying pressurized fuel to said injecting port, said second surface of said nozzle needle, and said pump chamber.

2. A fuel injector according to claim 1, wherein a disk is provided between said piezoelectric actuator and said piston; a pressure chamber being defined by said disk, said first cylinder bore, and said piston; and said disk being formed with a hole through which said one side projects toward said piezoelectric actuator.

3. A fuel injector according to claim 2, wherein said pressing means comprises said pressure chamber to which pressurized fuel is supplied.

4. A fuel injector according to claim 2, wherein said pressing means comprises a conical spring fitted in said pressure chamber.

5. A fuel injector according to claim 1, wherein said body is provided with a cylinder member, said first cylinder bore being formed in said cylinder member.

6. A fuel injector according to claim 1, wherein said body is provided with a distance piece which faces said other side of said piston and is formed with an opening through which the pressure in said pump chamber is transmitted to said first surface of said nozzle needle.

7. A fuel injector according to claim 1, wherein said body is provided with a nozzle body, which has a thick cylinder portion fitted in said body and a slender cylinder portion which projects outside of said body, said second cylinder bore being formed in said thick cylinder portion, said injecting port being formed on said slender cylinder portion.

8. A fuel injector according to claim 7, wherein said nozzle needle has a large diameter portion and a small diameter portion, said large diameter portion being loosely fitted in said second cylinder bore, said small diameter portion being loosely fitted in a needle bore formed in said slender cylinder portion, said second surface being formed between said large diameter portion and said small diameter portion.

9. A fuel injector according to claim 8, wherein said nozzle body is formed with a fuel reservoir to which pressurized fuel is supplied, said second surface facing said fuel reservoir.

* * * * *